US011336055B2

(12) United States Patent
Kropiewnicki

(10) Patent No.: US 11,336,055 B2
(45) Date of Patent: May 17, 2022

(54) LOCKING CLIP FOR AN ELECTRICAL CONNECTOR HOUSING

(71) Applicant: HARTING ELECTRIC GMBH & CO. KG, Espelkamp (DE)

(72) Inventor: Norbert Kropiewnicki, Bielefeld (DE)

(73) Assignee: Harting Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/760,367

(22) PCT Filed: Oct. 24, 2018

(86) PCT No.: PCT/DE2018/100868
§ 371 (c)(1),
(2) Date: Apr. 29, 2020

(87) PCT Pub. No.: WO2019/086070
PCT Pub. Date: May 9, 2019

(65) Prior Publication Data

US 2020/0358225 A1 Nov. 12, 2020

(30) Foreign Application Priority Data

Nov. 6, 2017 (DE) ..... 10 2017 125 860.4

(51) Int. Cl.
*H01R 13/629* (2006.01)

(52) U.S. Cl.
CPC . *H01R 13/62938* (2013.01); *H01R 13/62955* (2013.01); *H01R 13/62966* (2013.01)

(58) Field of Classification Search
CPC ..... H01R 13/62938; H01R 13/62955; H01R 13/62966; H01R 13/62933; H01R 13/62988
See application file for complete search history.

(56) References Cited

U.S. PATENT DOCUMENTS 5,154,629 A * 10/1992 Carver ..... G02B 6/3817 439/352
5,197,900 A * 3/1993 Ellis ..... H01R 13/6215 439/350

(Continued)

FOREIGN PATENT DOCUMENTS

CN 102017319 A 4/2011
CN 104425938 A 3/2015

(Continued)

OTHER PUBLICATIONS

Chinese Office Action dated Dec. 1, 2020, for Chinese Application No. 201880070651.4, 7 pages.

(Continued)

*Primary Examiner* — Travis S Chambers
(74) *Attorney, Agent, or Firm* — Seed IP Law Group LLP

(57) ABSTRACT

An electrical connector housing is provided with at least one locking clip, which is mounted pivotably via a bearing pin and has a locking region and an actuation region. In order to reversibly lock the electrical connector housing to a mating electrical connector housing, the locking region engages overbearing journals integrally moulded on the mating electrical connector housing. The locking clip has a locking device or means for blocking the pivot movement of the locking clip. In this manner, an accidental release of the plug-in connection can be prevented.

11 Claims, 3 Drawing Sheets

(56) References Cited

U.S. PATENT DOCUMENTS

| | | | | |
|---|---|---|---|---|
| 5,658,162 | A | 8/1997 | Harting et al. | |
| 6,319,050 | B1 | 11/2001 | Miyazaki et al. | |
| 6,666,697 | B2 * | 12/2003 | Yamashita | H01R 13/62977 439/152 |
| 6,863,551 | B2 * | 3/2005 | Fukamachi | H01R 13/64 439/157 |
| 6,881,081 | B2 * | 4/2005 | Gundermann | H01R 13/639 439/157 |
| 7,070,438 | B2 * | 7/2006 | Dillon | H01R 13/62977 439/157 |
| 7,137,844 | B2 * | 11/2006 | Flowers | H01R 13/5812 439/372 |
| 8,449,314 | B1 * | 5/2013 | Feist | H01R 13/512 439/358 |
| 8,641,433 | B2 * | 2/2014 | Uchida | H01R 13/62955 439/157 |
| 8,784,127 | B2 * | 7/2014 | Bashkin | H01R 13/62944 439/372 |
| 9,385,473 | B2 | 7/2016 | Iwatani | |
| 9,812,813 | B1 | 11/2017 | Sakamoto et al. | |
| 10,566,728 | B1 * | 2/2020 | Sundarakrishnamachari | H01R 13/6278 |
| 10,833,452 | B2 * | 11/2020 | Loas | H01R 13/639 |
| 2007/0099461 | A1 * | 5/2007 | Pittenger | H01R 13/62977 439/157 |
| 2011/0034049 | A1 | 2/2011 | Shishikura et al. | |
| 2012/0318645 | A1 | 12/2012 | Kobayashi et al. | |
| 2015/0079830 | A1 | 3/2015 | Iwatani | |

FOREIGN PATENT DOCUMENTS

| | | | |
|---|---|---|---|
| DE | 600 16 140 | T2 | 11/2005 |
| DE | 10 2014 017 625 | A1 | 6/2015 |
| EP | 0 731 534 | B1 | 12/1999 |
| EP | 2 059 979 | B1 | 12/2012 |
| EP | 2 535 913 | B1 | 6/2013 |
| JP | 2016-110735 | A | 6/2016 |

OTHER PUBLICATIONS

International Preliminary Report On Patentability, dated May 12, 2020 for International Application No. PCT/DE2018/100868, 7 pages.

European Patent Office, International Search Report for international application No. PCT/DE2018/100868, dated Jan. 11, 2019, 6 pages (with English translation).

German Patent Office, Office Action for German application No. 10 2017 125 860.4, dated Oct. 22, 2018, 9 pages.

* cited by examiner

LOCKING CLIP FOR AN ELECTRICAL CONNECTOR HOUSING

BACKGROUND

Technical Field

This disclosure relates to a locking clip for an electrical connector housing, and further relates to a method for the employment of such a locking clip.

Locking clips are employed for the reversible connection of an electrical connector housing with a mating electrical connector housing. The locking clip is firstly provided in the interests of the impeccable contact of the two electrical connector housings, thereby ensuring a reliable plug connection. Secondly, the locking clip is intended to prevent any unintentional release of the plug connection of the two electrical connector housings.

Locking clips of this type are employed in "industrial connectors", which are also described or referred to as rectangular connectors or heavy-duty connectors. Connectors and mating connectors of this type are employed for the constitution of an electrical and mechanical connection between two electrical conductors or between an electrical conductor and a device or installation in an industrial environment. Large, heavy-duty connectors, which are protected against environmental influences by the housing, are particularly required for the transmission of high currents. Housings which incorporate locking clips of this type are customarily comprised of aluminum, and are provided with a thread for the accommodation of a cable gland.

Description of the Related Art

EP 0 731 534 B1 discloses a locking clip which is pivotably mounted on the electrical connector housing. The locking clip is configured in a U-shape, with sockets extending in its side pieces. A spring element is inserted in each of these sockets. A "clamp" is arranged at the end of the spring element.

For the locking together of two electrical connector housings, the locking clip is pivoted in the plug-in direction of the electrical connector housing which is connected thereto. Upon the closing of the locking clip, the respective spring element is engaged over a locking pin of a mating electrical connector housing. The clamp is thus snap-fitted onto the locking pin. By means of the spring element and the clamp, the electrical connector housings are compressed against each other in a spring-loaded arrangement.

For the release of the electrical connector housing, it is necessary for the locking clip to be pivoted conversely to the plug-in direction of the electrical connector housing which is connected thereto.

In the locked state, the locking clip is in an upper position, in the region of the mating electrical connector housing. It can thus occur that, for example, by the leaning of a worker on a machine in the region of the plug connection, the locking function actuates the locking clip, and both the locking function and the plug connection are inadvertently released as a result.

The upward compression of a locking clip is invariably perceived by a user as more difficult than downward compression. Accordingly, the opening of a plug connection by means of the locking clip according to the prior art is perceived to be easier than the closing thereof. This is due to the fact that, during the downward compression of the locking clip, the user's own weight can be employed by way of support.

BRIEF SUMMARY

Embodiments of the present invention provide a locking clip which ensures a secure locking of two electrical connector housings to each other and which, at the same time, cannot be inadvertently opened.

The electrical connector housing according to embodiments of the present invention is equipped with at least one locking clip. The electrical connector housing generally assumes a rectangular cross-section. If only one locking clip is provided, this is arranged on the long side of the electrical connector housing. If two locking clips are provided, one locking clip respectively is arranged on each narrow side of the electrical connector housing.

The electrical connector housing comprises bearing pins, on which the locking clip is pivotably mounted. The locking clip is provided for the reversible locking of the electrical connector housing to a mating electrical connector housing. By way of the locking clip, the electrical connector housings are compressed against each other by a spring action. In general, a seal is provided in the region of the interface between the interconnected electrical connector housings, which prevents the penetration of media.

The locking clip comprises a locking region and an actuating region. The locking region assumes the locking function of the locking clip. The actuating region is configured such that a user can easily pivot the locking clip.

Preferably, the locking region of the locking clip is configured analogously to the locking clip according to EP 0 731 534 B1. This represents a proven technology.

According to embodiments of the present invention, the locking clip comprises a locking device or means, the function of which is to block the pivoting movement of the locking clip. Appropriately, the locking clip is blocked in the position in which the electrical connector housings are locked to each other.

According to a particularly advantageous embodiment, the locking clip assumes a basic U-shape. The locking clip comprises an actuating grip, which essentially constitutes the actuating region. Side pieces project perpendicularly from the actuating grip, the ends of which constitute the locking region. The side pieces comprise sockets, which are oriented in the direction of said side pieces, in each of which a spring element is mounted. The spring element essentially assumes a basic C-shape. A "clamp" is located at the upper end of the spring element. Upon the closure of the locking clip, the clamp engages over the respective locking pin of the mating electrical connector housing.

In one advantageous embodiment of the invention, the locking clip comprises a bearing axis, which is arranged between the locking region and the actuating region. As a result, a particularly favorable lever action is generated for a user of the locking clip. The locking clip can thus also be easily pivoted by persons having limited physical strength.

Preferably, the locking device or means, which secures the locking clip in its locking position, is arranged in the region of the actuating grip. This position is easily visible to a user, and simplifies the operation of the locking clip, as the locking clip can thus additionally be operated one-handed. If two locking clips are provided, the user can release the plug connection with both hands in a single operating step.

According to a particularly advantageous embodiment, the locking device or means comprises a latching hook. A matching recess is provided in the electrical connector housing, in which the latching hook can engage in order to block the pivoting movement of the locking clip. The mechanical combination of the latching hook and a recess is particularly wear-resistant, and thus additionally permits a high number of plug-in cycles.

Preferably, a spring element is arranged in the region of the actuating grip of the locking clip, which is operatively connected to the locking device or means. The spring force of the spring element is oriented such that the latching hook of the locking device or means—in the locked position of the locking clip—is compressed or urged into the recess of the electrical connector housing. Upon the closure of the locking clip, the latching hook thus executes an automatic snap-fit into the recess of the electrical connector housing, and immediately the locking clip is engaged in its terminal locked position.

Advantageously, the spring element is a coil spring. A coil spring is cost-effective, and can easily be replaced, once worn.

It is particularly advantageous if the locking device or means is pivotably mounted along an axis of rotation in the region of the actuating grip. The pivoting axis of the locking device or means is thus oriented perpendicularly to the pivoting axis of the locking clip. As a result, during the locking movement of the locking clip, the locking device or means can firstly be pivoted back in front of the recess in the electrical connector housing, and thereafter pivoted into or engaged in said recess. Prior to any pivoting open movement, the locking device or means must firstly—conversely to the spring force of the spring element—be pivoted out of the recess, before the locking clip is released to execute any pivoting open movement. The locking clip and the locking device or means integrated therein can be operated virtually simultaneously in a single sequence of movement. As a result, the locking clip conceived herein can be operated in a particularly ergonomic manner.

A brief description of how two electrical connector housings are locked together according to aspects of the invention, and released again thereafter, is set out below:

a) Firstly, the electrical connector housing, on which at least one locking clip according to embodiments of the invention is pivotably mounted, is mated in an exact fit to a mating electrical connector housing. Upon mating, contact elements which are located in the respective electrical connector housings are also mutually contact-connected.

b) Once the electrical connector housings have been plugged together, the at least one locking clip is pivoted conversely to the plug-in direction of the electrical connector housing.

c) The locking region of the locking clip thus engages over the bearing pins of the mating electrical connector housing. As a result, the electrical connector housings are compressed against each other in a spring-loaded arrangement. The spring force is delivered by the C-shaped spring element which is located in the sockets of the side pieces of the locking clip.

d) Once the locking clip has achieved its locking position, the locking clip is secured in this position by the integrated locking device or means. Any unintentional opening of the plug connection is prevented as a result.

e) Upon the opening of the plug connection, the locking device or means must firstly be released. The latching hook of the locking device or means is thus withdrawn from the recess in the electrical connector housing.

f) The at least one locking clip can then be pivoted in the plug-in direction of the electrical connector housing.

g) The electrical connector housings can then be drawn apart, and the plug connection interrupted accordingly.

In a particularly advantageous configuration of the invention, the locking device or means can be fastened to the locking clip in the locked position. A shackle lock, for example, can be employed for this purpose. Prevention of the unintentional separation of the plug connection, or the separation thereof by unauthorized persons, is thus ensured.

By way of its properties, the locking clip proposed herein provides a particular degree of security. The locking device or means integrated in the locking clip protect a plug connection against unintentional opening. The pivoting movement of the locking clip is moreover configured such that locking is executed by a downward compression of the locking clip. This movement is perceived by a user as easy. Upon unlocking, the locking clip must be compressed upwards. This movement is somewhat more difficult for a user to execute, and must therefore be executed deliberately.

BRIEF DESCRIPTION OF THE SEVERAL VIEWS OF THE DRAWINGS

Exemplary embodiments of the invention are represented in the drawings, and are described in greater detail hereinafter. In the drawings.

The figures may contain partially simplified schematic representations. In some cases, the same reference numbers are employed for similar, but optionally not identical elements. Different views of the same elements may be represented to different scales.

DETAILED DESCRIPTION

Figure 1:
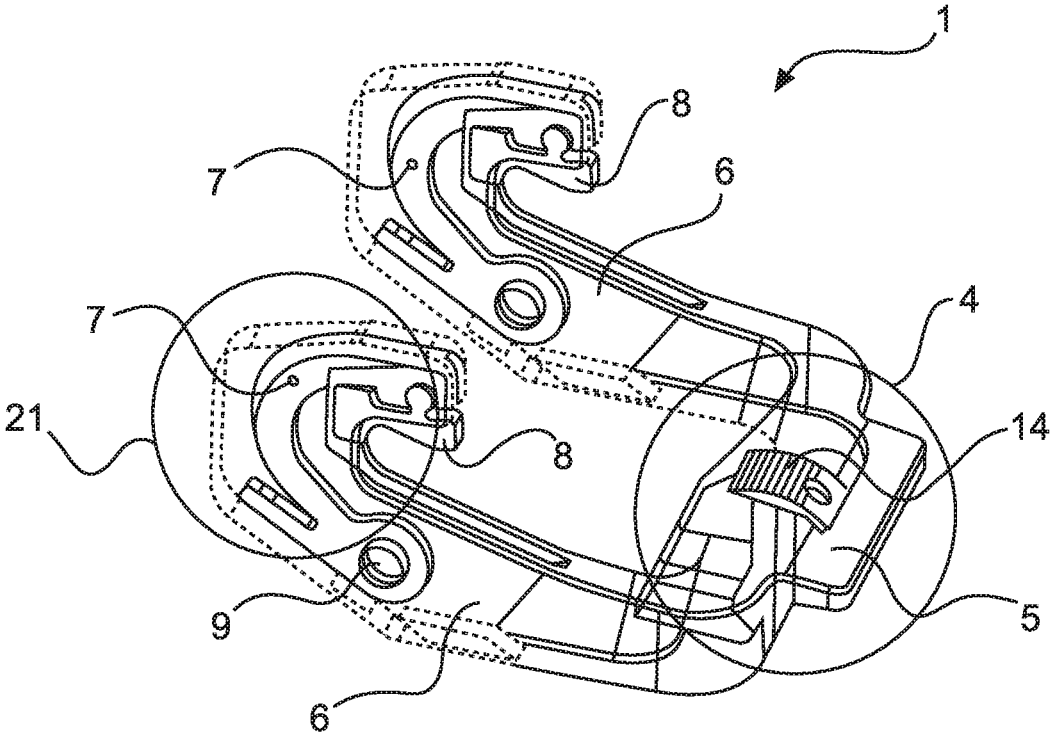
FIG. 1 shows a partially transparent perspective representation of a locking clip.
Figure 2:
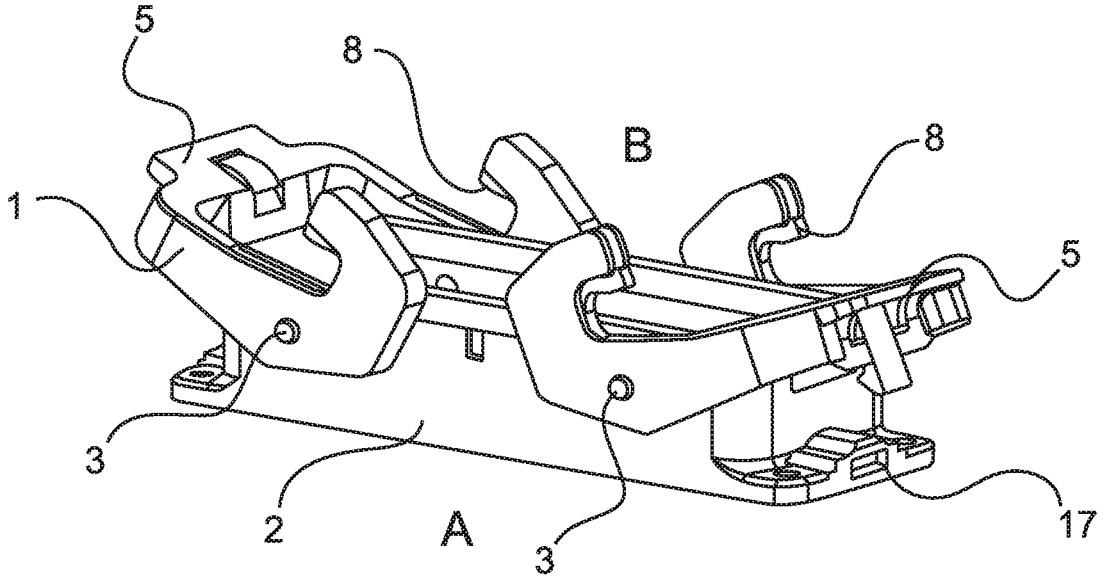
FIG. 2 shows a perspective representation of an electrical connector housing according to one example embodiment of the invention.
Figure 3:
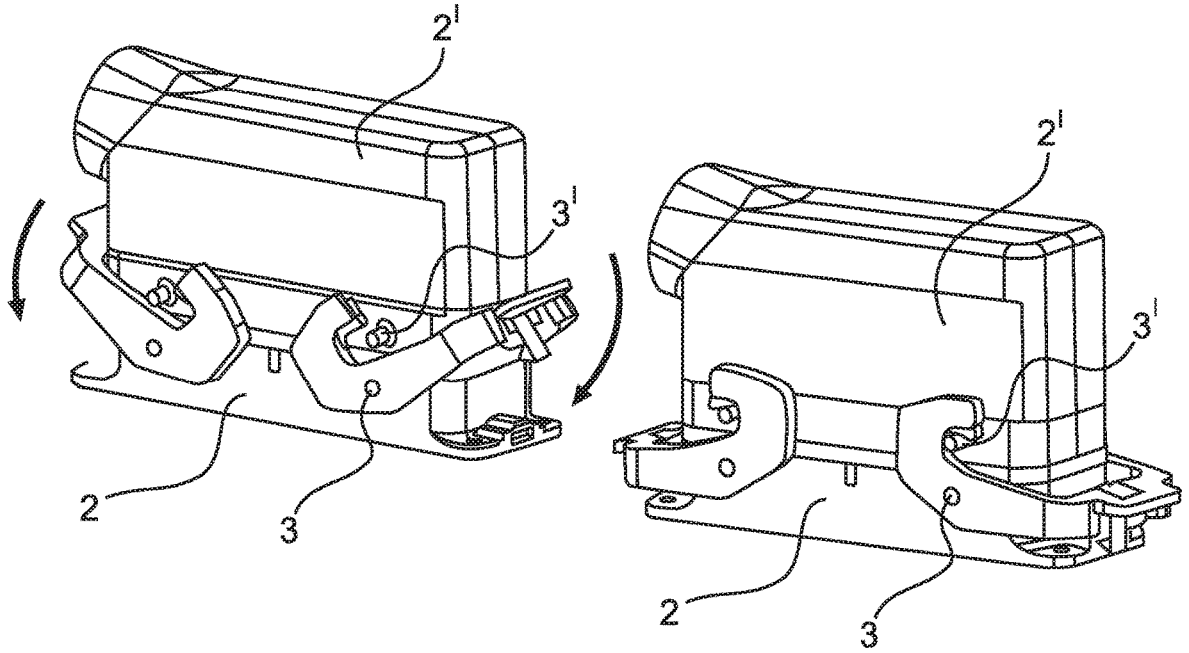
FIG. 3 shows two electrical connector housings, respectively in an unlocked and in a mutually interlocked state.

FIG. 1 shows a partially transparent perspective representation of a locking clip 1, according to one example embodiment, which is pivotably mounted on an electrical connector housing 2, on bearing pins 3. The electrical connector housing represented in FIG. 2 is also described as a built-on housing, as it can be built onto, for example, a machine (not represented).

The electrical connector housing 2 is essentially configured with a cuboid shape. The exposed surfaces are described as the connection side A and the plug-in side B. One locking clip 1 is pivotably mounted on each of the narrow sides of the electrical connector housing 2.

The locking clip 1 is essentially configured with a U-shape. The locking clip comprises an actuating region, onto which an actuating grip 5 is integrally molded. Two side pieces 6 project perpendicularly from the actuating region 4, comprising sockets which extend in the direction of said side pieces 6, in each of which a C-shaped spring element 7 is arranged. At the lower end, the spring element 7 incorporates a through-opening 9, such that the spring element 7 is likewise secured by way of the bearing pins 3 of the electrical connector housing 2. The spring elements 7 are provided with an end-mounted clamp 8. The connection between the spring element 7 and the clamp 8 is form-fitted. Upon locking, the end-mounted clamps 8 engage over the bearing pins 3' of a mating electrical connector housing 2'. At their ends, the side pieces 6 comprise a locking region 21.

The connecting line of the through-openings 9 constitutes the bearing axis of the locking clip 1. The bearing axis is arranged between the locking region 21 and the actuating region 4. As a result, an optimum lever action is generated by the locking and unlocking movement of the locking clip 1.

Figure 4:
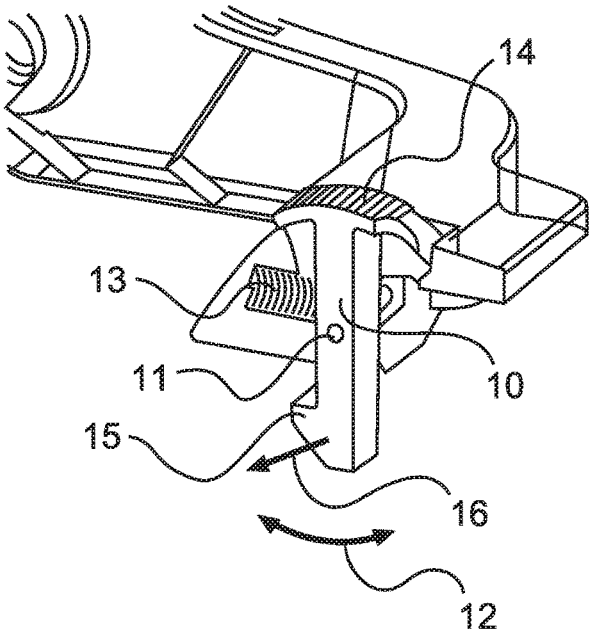
FIG. 4 shows a perspective view of a section of the actuating region of the locking clip.

In the actuating region 4 of the locking clip 1, a locking device or means 10 is arranged. The functional interaction of the locking device or means 10 can clearly be seen in FIG. 4. The locking device or means 10 is pivotably mounted on a bearing axis 11. The locking device or means 10 can be pivoted along the double-headed arrow 12. The pivoting direction is oriented perpendicularly to the pivoting movement of the locking clip 1. The locking device or means 10 is essentially configured with a T-shape, and is operatively connected to a coil spring 13. In place of a coil spring 13, a spring element of an elastomer material can also be provided.

At the upper end, the locking device or means 10 comprises an actuating head 14 with an unfinished surface structure. By way of the actuating head 14, the locking device or means 10 can be pivoted along the double-headed arrow 12. At the lower end, the locking device or means 10 comprises a latching hook 15. The spring force of the coil spring 13 drives the latching hook 15 continuously in the direction of the arrow 16, and thus into a recess 17 in the electrical connector housing 2. If the locking clip 1 is in its lower position, which constitutes the locking position, it is automatically secured in this position by the locking device or means 10. Only once the latching hook 15 has been actively withdrawn from the recess 17 in the electrical connector housing 2, by way of a pivoting movement which is initiated by the actuating head 14, is the plug connection released, such that it can then be separated.

Figure 5:
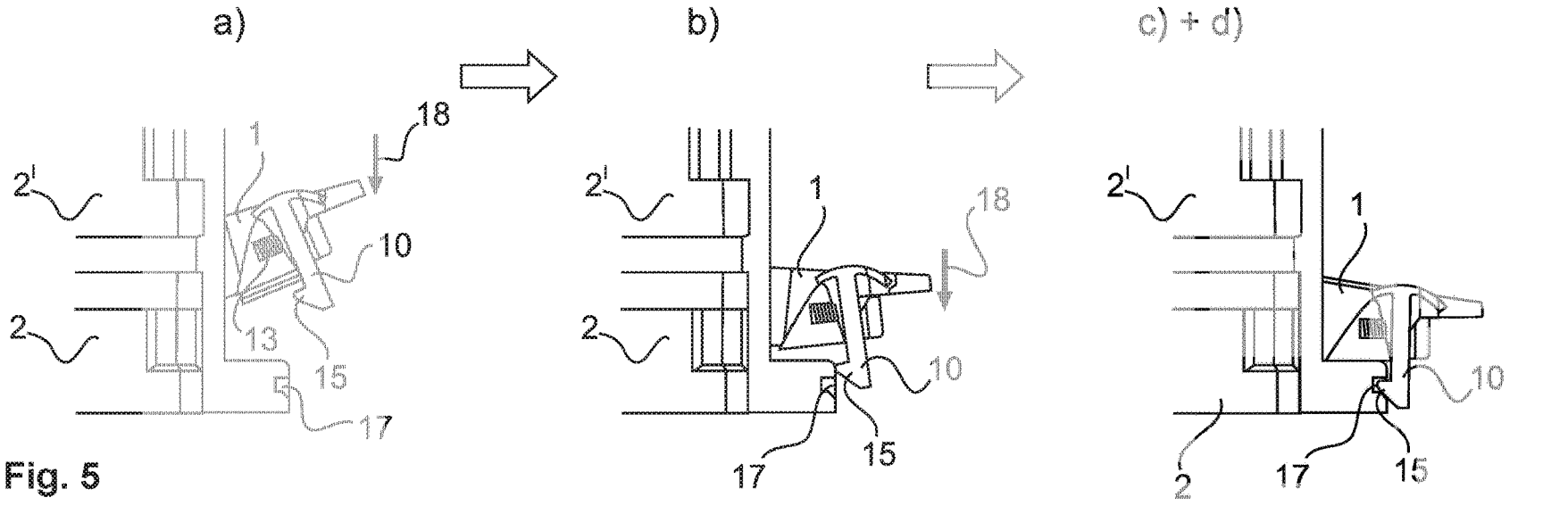
FIG. 5 shows a systematic sequence of images for a locking method of two electrical connector housings.

A method for locking an electrical connector housing 2 to a mating electrical connector housing is schematically represented in FIG. 5. The temporal sequence proceeds from left to right:

a) In the left-hand image, the electrical connector housing 2 and the mating electrical connector housing 2' are arranged in an exactly mutually oriented state. The electrical connector housings 2, 2' have previously been brought together in the plug-in direction.

b) In the next image, it can be seen that the locking clip 1 is then pivoted conversely to the plug-in direction of the electrical connector housing—in the direction of the arrow 18.

c) In the right-hand image, it can be seen that, by the pivoting movement, the locking region 4 of the locking clip 1 engages over the bearing pins 3' of the mating electrical connector housing 2', and d) simultaneously, the locking device or means 10 secures the locking clip 1 in its terminal position or locking position.

Figure 6:
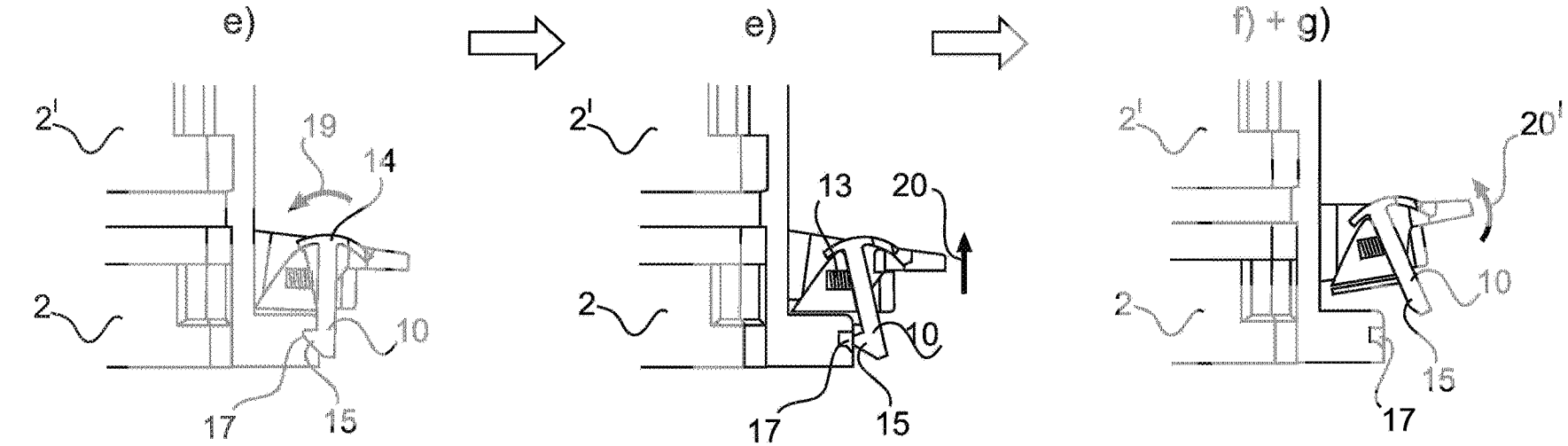
FIG. 6 shows a systematic sequence of images for an unlocking method of two electrical connector housings.

FIG. 6 shows an analogous representation of the process for the unlocking of the electrical connector housing 2 and the mating electrical connector housing 2':

e) Firstly, by way of the locking device or means 10, the locking clip 1 is released from its locking position. The actuating head 14 of the locking device or means 10 is thus pivoted in the direction of the arrow 19—i.e., towards the electrical connector housing 2. The latching hook 15 of the locking device or means 10 is thus extracted from the recess 17 in the electrical connector housing 2. During this process, the user is required to deliberately counteract the spring force of the spring element 13. Any inadvertent release is precluded accordingly.

f) The locking clip 1 is then pivoted in the plug-in direction of the electrical connector housing 2—in the direction of the arrow 20, 20'.

If the locking clip 1 is in its upper position or unlocking position, the electrical connector housing 2 and mating electrical connector housing 2'—conversely to their respective plug-in direction—can be drawn apart.

Although various aspects or characteristics of embodiments of the invention are represented in combination in the figures in each case, it will be evident to a person skilled in the art—unless indicated otherwise—that the combinations represented and discussed are not the only ones possible. In particular, mutually corresponding units or series of characteristics from different exemplary embodiments can be interchanged.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. An electrical connector housing comprising at least one locking clip which is pivotably mounted by a bearing pin, the at least one locking clip having a locking region and an actuating region for moving the locking clip between an unlocked clip position and a locked clip position, wherein the electrical connector housing is lockable to a mating electrical connector housing by the locking region of the locking clip when moving the locking clip from the unlocked clip position to the locked clip position, wherein the locking clip further comprises a locking device separate and distinct from the locking region, which locking device is movable between a latched position and an unlatched position, wherein pivoting movement of the locking clip away from the locked clip position is prevented when the locking device is in the latched position, and wherein the locking device includes a user-manipulable actuating head accessible at an upper side of the actuating region of the locking clip remote from the locking region to selectively move the locking device from the latched position to the unlatched position to release the locking device from preventing the pivoting movement of the locking clip.

2. The electrical connector housing, as claimed in claim 1, wherein the locking device is pivotably mounted along an axis of rotation in a region of the actuating grip.

3. The electrical connector, as claimed in claim 1, wherein the locking clip assumes a basic U-shape, having an actuating grip and two side pieces which project perpendicularly from the actuating grip, and wherein ends of the side piece constitute the locking region.

4. The electrical connector, as claimed in claim 1, wherein the locking clip comprises a bearing axis, which is arranged between the locking region and the actuating region.

5. The electrical connector housing, as claimed in claim 4, wherein the locking device comprises a latching hook at an opposing end of the locking device opposite of the user-manipulable actuating head and in an area below the actuating region of the locking clip.

6. The electrical connector housing, as claimed in claim 5, wherein the electrical connector housing incorporates a recess, in which the latching hook is configured to engage in order to block the pivoting movement of the locking clip.

7. The electrical connector housing, as claimed in claim 3, wherein the locking device is arranged in a region of the actuating grip.

8. The electrical connector, as claimed in claim 7, wherein a spring element is arranged in the region of the actuating grip of the locking clip, which is operatively connected to the locking device.

9. The electrical connector housing, as claimed in claim 8, wherein a spring force of the spring element is oriented such that a latching hook of the locking device is urged into a recess of the electrical connector housing.

10. A method for employing an electrical connector housing comprising at least one locking clip which is pivotably mounted by a bearing pin, the at least one locking clip having a locking region and an actuating region for moving the locking clip between an unlocked clip position and a locked clip position, the locking clip further comprising a locking device separate and distinct from the locking region, which locking device is movable between a latched position and an unlatched position, wherein pivoting movement of the locking clip away from the locked clip position is prevented when the locking device is in the latched position, and wherein the locking device includes a user-manipulable actuating head accessible at an upper side of the actuating region of the locking clip remote from the locking region to selectively move the locking device from the latched position to the unlatched position to release the locking device from preventing the pivoting movement of the locking clip, the method comprising:

mating the electrical connector housing in an exact fit to a mating electrical connector housing in a plug-in direction; and pivoting the at least one locking clip conversely to the plug-in direction of the electrical connector housing, as a result of which the locking region of the locking clip engages over a bearing pin of the mating electrical connector housing, and as a result of which the locking device secures the locking clip in the locked clip position.

11. The method as claimed in claim 10, further comprising:

releasing the locking clip from the locked clip position by way of the user-manipulable actuating head of the locking device;

pivoting the at least one locking clip in the plug-in direction of the electrical connector housing; and drawing the electrical connector housing and the mating electrical connector housing apart conversely to the plug-in direction.

* * * * *